US005642551A

United States Patent [19]

Cann et al.

[11] Patent Number: 5,642,551

[45] Date of Patent: Jul. 1, 1997

[54] TWIST MOP

[75] Inventors: Robert A. Cann, Amherst, Mass.; Luis R. Agrela, Cumberland, R.I.

[73] Assignee: Easy Day Manufacturing Company, Holliston, Mass.

[21] Appl. No.: 684,176

[22] Filed: Jul. 19, 1996

[51] Int. Cl.[6] ..... A47L 13/142

[52] U.S. Cl. ..... 15/120.1

[58] Field of Search ..... 15/116.1, 116.2, 15/119.1, 119.2, 120.1, 120.2

[56] References Cited

U.S. PATENT DOCUMENTS 1,514,051 11/1924 Jumonville ..... 15/120.2
3,151,475 10/1964 Johnson ..... 15/120.1 X
4,479,278 10/1984 Heinonen ..... 15/120.2
5,509,163 4/1996 Morad ..... 15/120.2
5,566,417 10/1996 Hsieh ..... 15/120.2
5,577,290 11/1996 Monahan ..... 15/120.1

*Primary Examiner*—Mark Spisich
*Attorney, Agent, or Firm*—Wolf, Greenfield & Sacks, P.C.

[57] ABSTRACT

A mop, comprising a handle, a wringing grip slidably mounted on the handle and a mop head mounted between the handle and the wringing grip, such that when the wringing grip is slid toward a distal end of the handle, the mop head is stretched between the proximal end of the handle and the wringing grip, the wringing grip being compressible against said handle so as to facilitate repeated twisting of the handle relative to the wringing grip by inhibiting the handle from untwisting after each twist of the handle.

13 Claims, 4 Drawing Sheets

TWIST MOP

FIELD OF THE INVENTION

The present invention relates to a twist mop having an improved integral wringing mechanism.

BACKGROUND OF THE INVENTION

It is known to provide a mop with an integral wringing mechanism to wring fluid from the mop head. Integral wringing mechanisms come in many forms and enable the user of the mop to wring out the mop head without the need for an additional, separate wringing mechanism. Such a prior art mop is shown in FIG. 1. This type of mop, commonly referred to as a "twist mop" includes a handle 10 inserted through a wringing grip 12. A mop head 14 is mounted between a mounting area 16 of wringing grip 12 and mounting bracket 18, which is attached to the bottom of handle 10. The portion of handle 10, which is located within mop head 14, is shown in phantom in FIG. 1. A fixed grip 20 is mounted to handle 10 in order to provide a second gripping surface. In use, wringing grip 12 is slid to the bottom of handle 10, which causes mop head 14 to slacken, thereby providing a surface area with which the user may mop a particular surface.

When the mop head 14 is to be wrung, wringing grip 12 is slid up handle 10 toward fixed grip 20, such as shown in FIG. 1, in order to stretch the mop head at 14 between mounting brackets 16 and 18. Wringing grip 12 and fixed grip 20 are then rotated in opposite directions in order to twist mop head 14 and wring out any fluid in the mop head. In this prior art design, however, since wringing grip 12 is designed to be noncompressible, twisting the mop head in order to wring it out requires the user to have both hands on the mop at all times while the mop head is being twisted, since, if either the wringing grip or the fixed grip are let go while the mop head is being twisted, the mop head will spring back into its normal, relaxed position. As a result, twisting the mop head is difficult and often results in a less than complete wring of fluids from the mop head. In addition, since both hands need to be used, extra energy and strength on the part of the user is necessary. This problem is magnified in the case of users with arthritis or limited hand strength.

Another prior art wringing system uses a plastic ratchet system which, while addressing the problem of the prior art mop of requiring the user to use both hands to wring the mop head, is cumbersome, more expensive, more complicated to use and requires numerous plastic pieces, which are prone to breakage.

It would thus be desirable to provide a simplified mop wringing system which is easier to use and doesn't require the user to have both hands on the mop at all times to prevent the mop head from untwisting while it is being wrung.

SUMMARY OF THE INVENTION

According to a general aspect, the invention features a twist mop having a wringing grip which enables the user to hold the handle in a fixed position after each twist of the mop head relative to the handle. The wringing grip is compressible against the handle in order to allow the user to squeeze the handle with the wringing grip in order to prevent the handle, and consequently the mop head, from untwisting.

In a preferred embodiment, the invention includes a mop, comprising a handle, a wringing grip slidably mounted on the handle, the wringing grip being compressible against the handle to inhibit movement of the handle relative to the wringing grip so as to facilitate repeated twisting of the handle relative to the wringing grip by inhibiting the handle from untwisting after each twist of the mop head. The wringing grip is rotatable about the handle when in a noncompressed, relaxed state and contacts the handle and therefore is not rotatable about the handle when in a compressed state. The mop head may be mounted between the handle and the wringing grip, such that when the wringing grip is slid toward a distal end of the handle, the mop head is stretched between the handle and the wringing grip. The wringing grip may be formed from a pliable material having a tackified surface on an internal wall thereof. The wringing grip may comprise at least one opening, such as a longitudinal slot in the wringing grip and a plurality of longitudinal ribs, disposed along an internal wall thereof.

DETAILED DESCRIPTION

Figure 1:
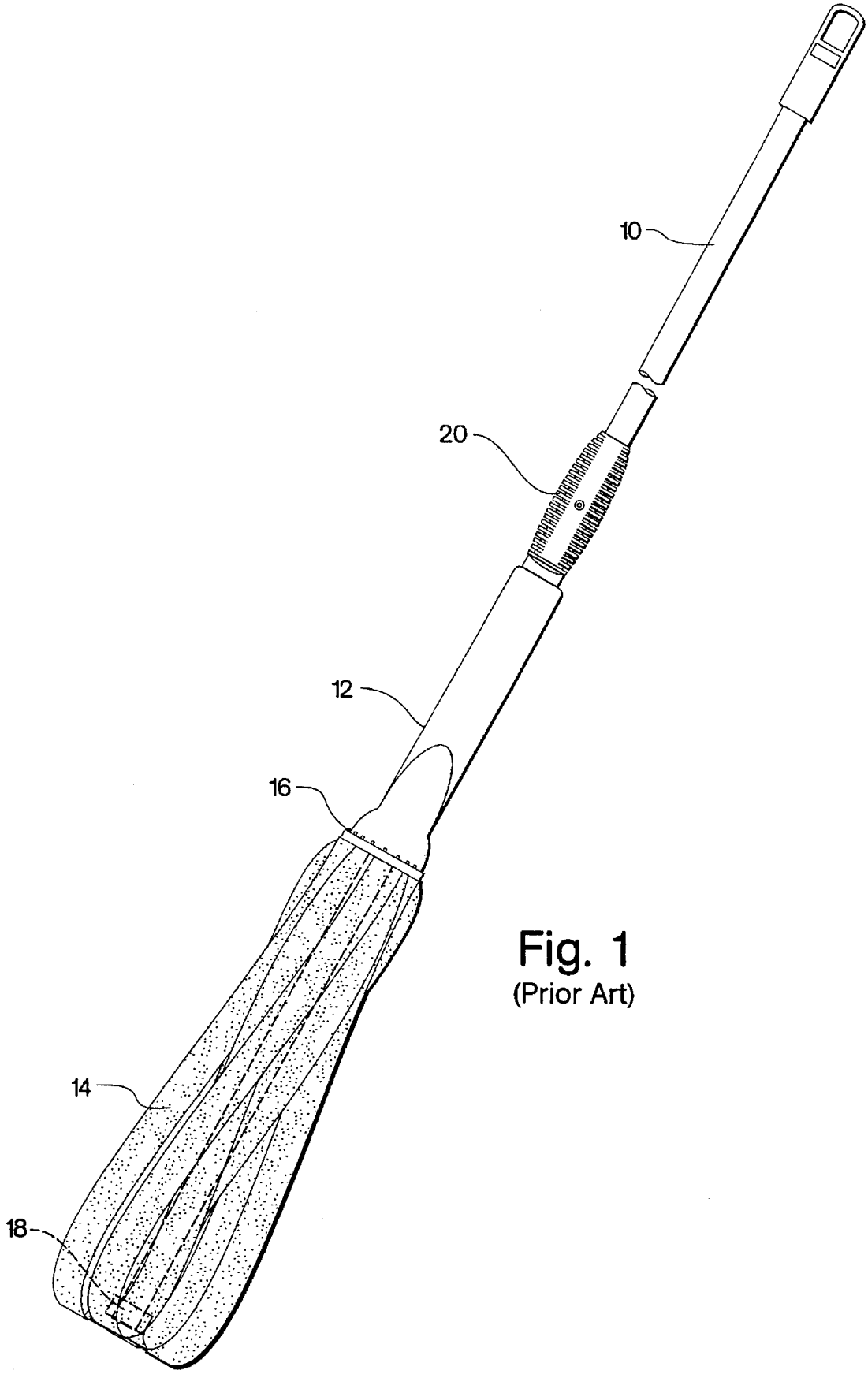
Fig. 1 (Prior Art)
FIG. 1 is a drawing of a prior art twist mop.
Figure 2:
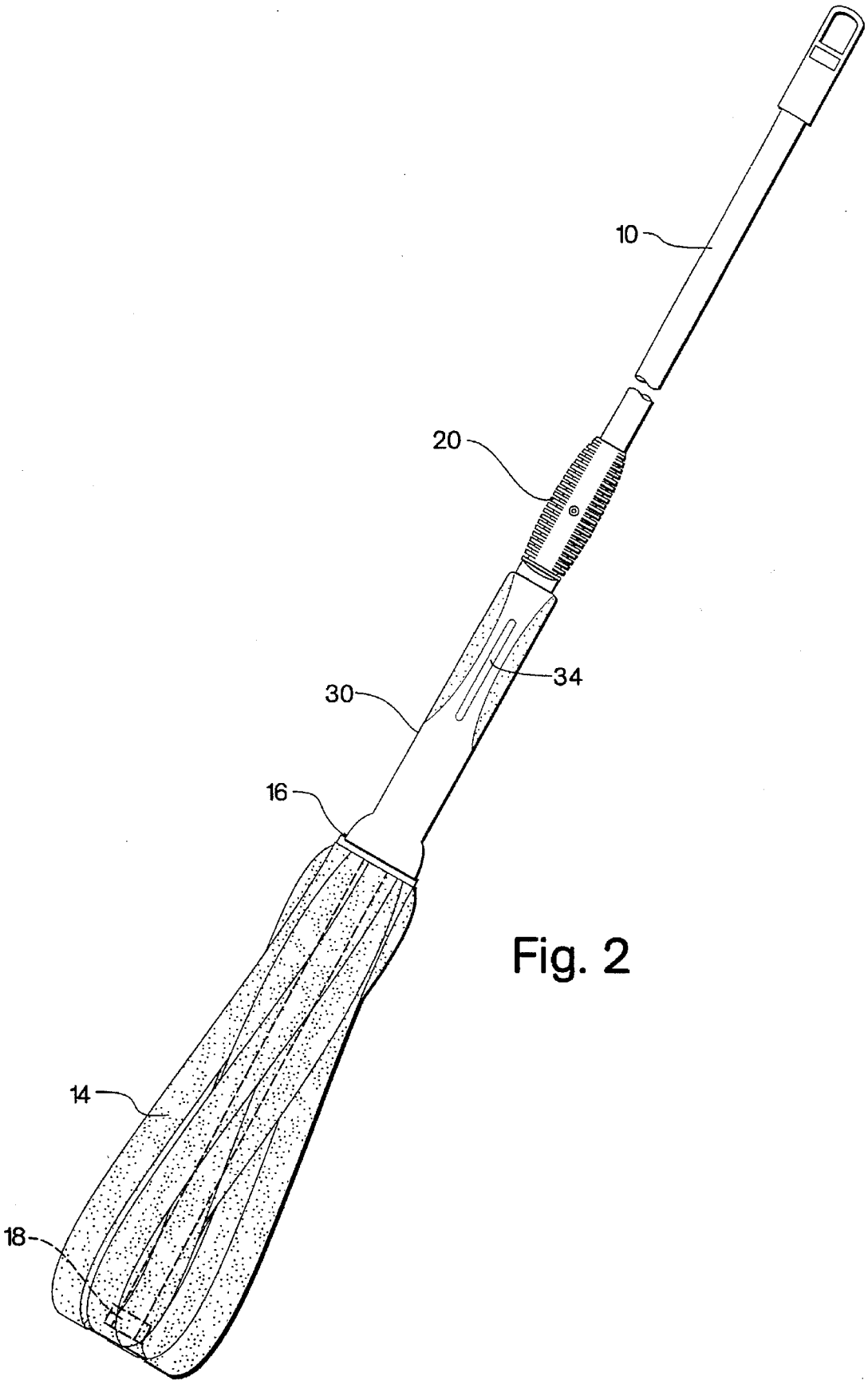
FIG. 2 is a drawing of the twist mop in accordance with the present invention.
Figure 3:
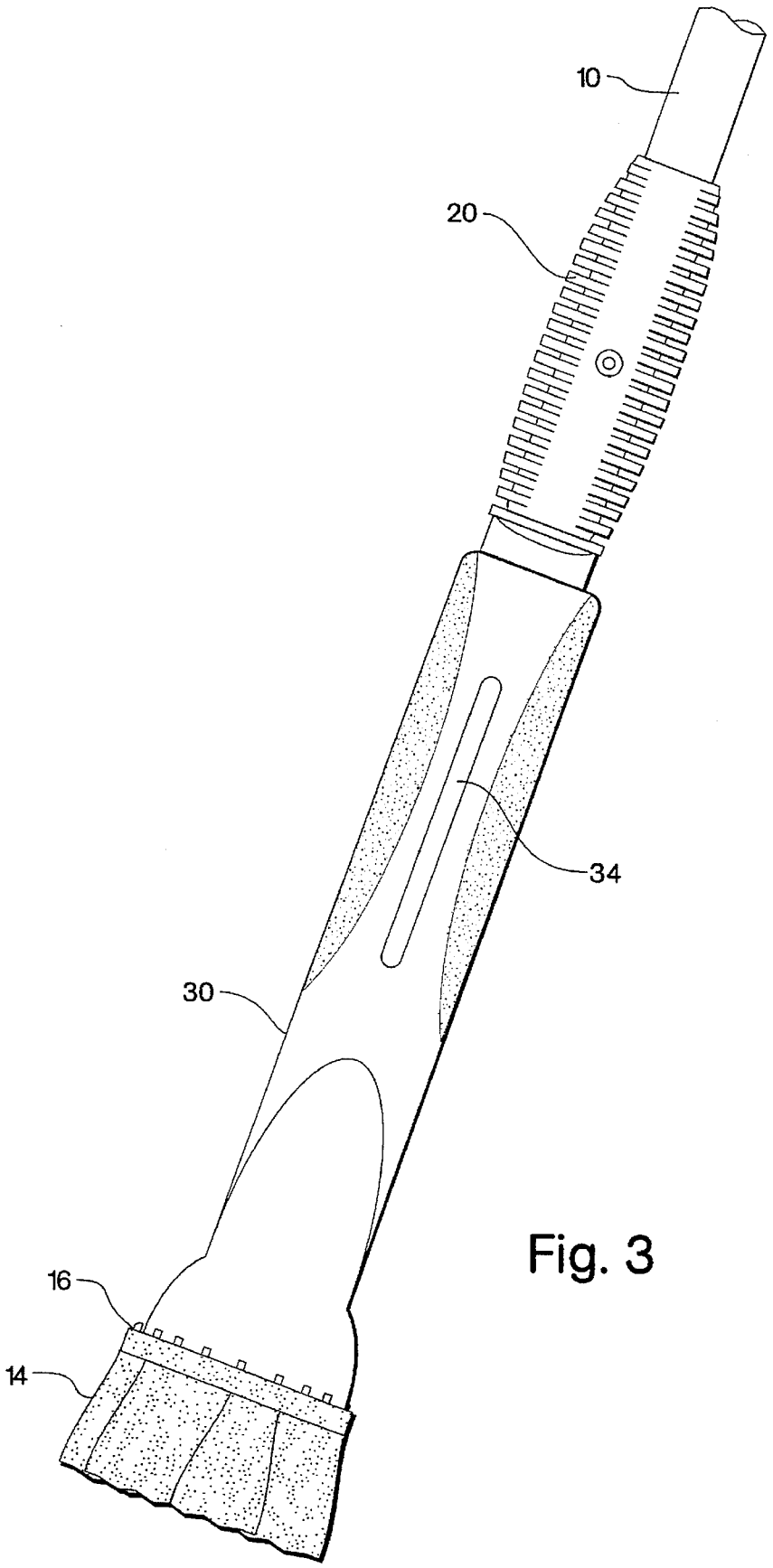
FIG. 3 is a close-up view of the wringing grip in accordance with the present invention.

The twist mop of the present invention is shown in FIG. 2. Similar to the prior art twist mop of FIG. 1, the present invention includes a handle 10, a mop head 14 mounted between mounting brackets 16 and 18, and a fixed grip 20 mounted to handle 10. However, wringing grip 30 of the present invention, which is preferably hollow and circumferentially surrounds handle 10, is compressible when depressed radially inwardly against handle 10 to prevent handle 10 from rotating relative to wringing grip 30 while the mop head 14 is being wrung between wringing grip 30 at bracket 16 and handle 10 at bracket 18. A close-up view of wringing grip 30, as well as handle 10, mop head 14, mounting bracket 16 and fixed grip 20 is shown in FIG. 3.

Figure 4B:
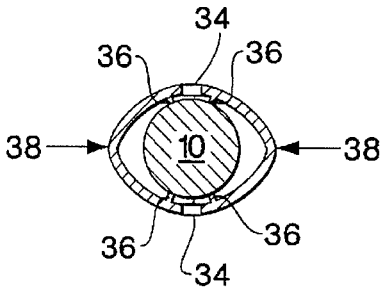
FIG. 4B is a cross-sectional view of the wringing grip in accordance with the present invention.
Figure 4A:
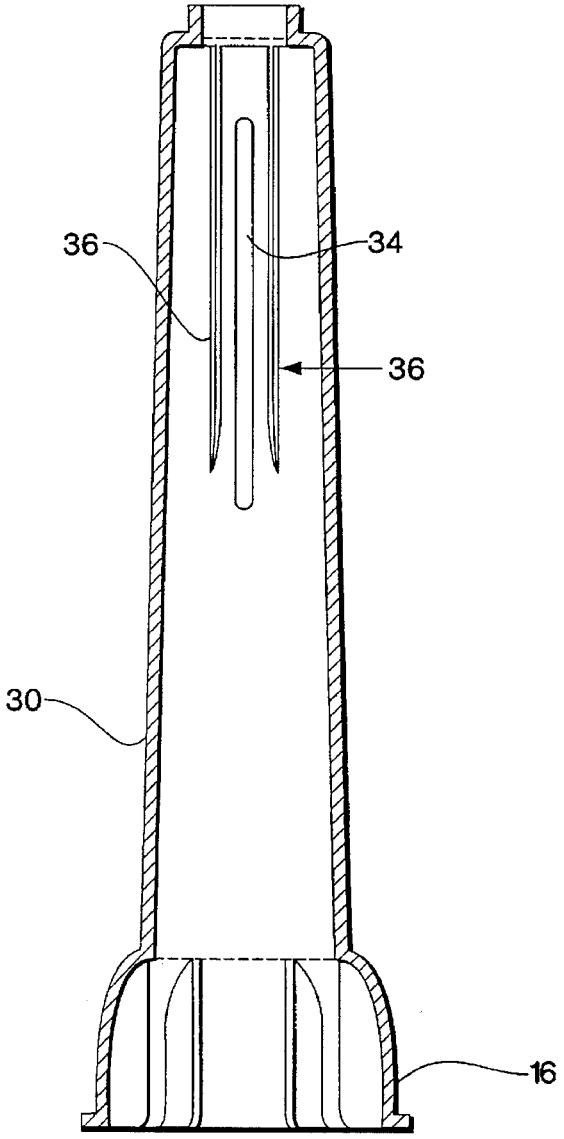
FIG. 4A is a cut-away view of the wringing grip in accordance with the present invention.

FIG. 4A is a cut-away view showing the details of wringing grip 30. In one embodiment, wringing grip 30 comprises opposing openings 34, which may be longitudinal slots, located in the upper portion of wringing grip 30 and opposing longitudinal ribs 36 located on the inside wall of wringing grip 30. Longitudinal slots 34 facilitate the compression of wringing grip 30. Openings 34 need not be longitudinal slots. They may be any other shape, and may comprise a series configuration of smaller openings. Wringing grip 30 is designed so that it is capable of being in two states: a relaxed state, when the grip is at rest and is rotatable about the handle, and a compressed state, when the grip is compressed and is fixed with respect to the handle.

As is shown in FIG. 4B, which is a cross-sectional view of wringing grip 30, when force is applied in the areas indicated by arrows 38 in a radial direction toward handle 10, such as when the user squeezes wringing grip 30 with his or her hand, longitudinal slots 34 are compressed, causing ribs 36 to come into contact with handle 10, the resulting friction holding handle 10 in place relative to wringing grip 30. This enables the user to twist wringing grip 30 with one hand and handle 10 with the other hand in opposite directions to the extent possible by the human hand, then compress wringing grip 30 against handle 10 with one hand in order to hold handle 10 in place relative to wringing grip 30, while repositioning the other hand on handle 10 in order to further twist the handle to wring mop head 14. This twisting process is repeated until the mop head is sufficiently wrung. This eliminates the need for the user to be constantly holding on to the mop with both hands in order to prevent the mop head from untwisting. As a result, the mop is easier to use and requires less energy and strength to wring fluid from the mop head.

In another embodiment, wringing grip 30 is formed from a material which is pliable enough to eliminate the need for openings 34. Therefore, when wringing grip 30 is compressed, handle 10 is held in place relative to wringing grip 30 as described above.

In the preferred embodiment, wringing grip 30 is made from molded plastic. In another embodiment, wringing grip 30 may include a tackified or rubberized inner surface, in order to enhance the ability of wringing grip 30 to hold handle 10. However, any material having sufficient strength, pliability, friction and elasticity to enable the grip to be repeatedly compressed against the handle and released to its relaxed state may be used in the manufacture of wringing grip 30. Any wringing grip having such features would not necessarily need openings, holes or slots, and would be within the scope of the invention.

Having thus described an embodiment of the invention, various alterations, modifications, and improvements will readily occur to those skilled in the art. Such alterations, modifications, and improvements are intended to be within the spirit and scope of the invention. For example, the grip structure of fixed grip 20 and wringing grip 30 may include ergonomic, raised fin portions which facilitate the twisting of the handle and the wringing grip. Also within the scope of the invention are embodiments in which the wringing grip does not fully surround the handle but is still capable of being depressed against the handle to frictionally hold the handle in place relative to the wringing grip or in which only a portion of an otherwise rigid wringing grip is compressible against the handle. Accordingly, the foregoing description is by way of example only and is not intended to be limiting.

What is claimed is:

1. A mop, comprising:

a handle;

a mop head; and a wringing grip slidably and rotatably mounted on said handle, said mop head being coupled between said wringing grip and said handle such that upon rotation of said wringing grip relative to said handle, said mop head is wrung;

said wringing grip having a compressible region that is constructed and arranged to compress upon application of an inwardly radial force, such that said wringing grip engages said handle;

whereby said wringing grip, when compressed against said handle, facilitates wringing of said mop head by inhibiting said wringing grip from rotating relative to said handle.

2. The mop of claim 1, wherein said wringing grip is perforated so as to increase the compressibility of said wringing grip.

3. The mop of claim 1, further including at least one opening in said wringing grip for increasing the compressibility of said wringing grip.

4. The mop of claim 3, wherein said at least one opening is a longitudinal slot in said wringing grip.

5. The mop of claim 1, wherein said wringing grip comprises a plurality of longitudinal ribs, disposed along an internal wall thereof.

6. The mop of claim 1 wherein said wringing grip comprises a pliable material having a tackified surface on an internal wall thereof.

7. A wringing mechanism for a mop, comprising:

a pliable wringing grip having a bore through which a mop handle is inserted, a mop head being coupled between said wringing grip and said handle such that upon rotation of said wringing grip relative to said handle, said mop head is wrung;

said pliable wringing grip being constructed and arranged to compress upon application of an inwardly radial force, such that said wringing grip engages said handle;

whereby said wringing grip, when compressed against said handle, facilitates wringing of said mop head by inhibiting said wringing grip from rotating relative to said handle.

8. The wringing mechanism of claim 7, wherein said wringing grip is perforated so as to increase the compressibility of said wringing grip.

9. The wringing mechanism of claim 7, wherein said wringing grip comprises a plurality of longitudinal ribs, disposed along an internal wall thereof.

10. The wringing mechanism of claim 7, further including at least one opening in said wringing grip for increasing the compressibility of said wringing grip.

11. The wringing mechanism of claim 10, wherein said at least one opening is a longitudinal slot in said wringing grip.

12. A mop, comprising:

a handle;

a mop head attached to the handle; and a grip portion slidably and rotatably mounted on said handle and operatively coupled to the mop head such that upon rotation of the grip portion relative to the handle, the mop head is twisted;

said grip portion having a compressible region that is constructed and arranged to compress toward said handle upon application of force to said compressible region, such that said wringing grip engages said handle;

whereby said grip portion, when compressed against the handle, inhibits movement of the handle relative to the grip portion.

13. A mop, comprising:

a handle;

a mop head attached to the handle; and a grip slidably and rotatably mounted on said handle and operatively coupled to the mop head such that upon rotation of the grip relative to the handle, the mop head is twisted;

said grip being constructed and arranged to compress upon application of force to said region;

wherein said grip is capable of two states, a relaxed state, wherein the grip is rotatable with respect to said handle, and a compressed state, wherein, upon said application of force to said grip, the grip is fixed with respect to said handle.

* * * * *